US008499602B2

(12) United States Patent
Gaylord et al.

(10) Patent No.: US 8,499,602 B2
(45) Date of Patent: Aug. 6, 2013

(54) DECORATIVE HOLLOW TUBING FOR USE IN FURNITURE MANUFACTURE AND METHOD FOR MANUFACTURING

(75) Inventors: Robert A. Gaylord, Virginia Beach, VA (US); Oliver Wang, Millbrae, CA (US)

(73) Assignee: Agio International Company, Ltd, Hong Kong (HK)

( * ) Notice: Subject to any disclaimer, the term of this patent is extended or adjusted under 35 U.S.C. 154(b) by 243 days.

(21) Appl. No.: 12/938,830

(22) Filed: Nov. 3, 2010

(65) Prior Publication Data

US 2011/0079064 A1 Apr. 7, 2011

Related U.S. Application Data

(63) Continuation-in-part of application No. 11/728,765, filed on Mar. 27, 2007, now abandoned, which is a continuation-in-part of application No. 10/436,013, filed on May 12, 2003, now abandoned.

(60) Provisional application No. 60/379,103, filed on May 10, 2002.

(51) Int. Cl.

| | |
|---|---|
| ***B21D 3/02*** | (2006.01) |
| ***B21D 15/02*** | (2006.01) |
| ***B21D 17/00*** | (2006.01) |
| ***B21C 37/30*** | (2006.01) |

(52) U.S. Cl.

USPC ..... 72/121; 72/370.2; 72/370.21; 72/370.24

(58) Field of Classification Search

USPC ..... 72/112, 120, 121, 370.21, 370.2, 72/370.19, 367.1, 102, 118, 119, 370.13, 72/74, 76, 370.23, 370.24

See application file for complete search history.

(56) References Cited

U.S. PATENT DOCUMENTS

| | | | | |
|---|---|---|---|---|
| 1,554,739 | A * | 9/1925 | Lewis | 72/370.19 |
| 1,939,065 | A * | 12/1933 | Kruse | 72/370.19 |
| 3,577,621 | A * | 5/1971 | De Gain | 72/370.19 |
| 3,632,273 | A | 1/1972 | Savickas | |
| 4,231,834 | A | 11/1980 | Trejo Gonzalez | |
| 4,377,083 | A | 3/1983 | Shepherd et al. | |
| 4,455,851 | A * | 6/1984 | Kienhofer | 72/76 |
| 5,894,753 | A * | 4/1999 | Sachot et al. | 72/370.04 |
| 7,905,130 | B2 * | 3/2011 | Marshall et al. | 72/121 |
| 2007/0237917 | A1 | 10/2007 | Gaylord et al. | |

* cited by examiner

*Primary Examiner* — Dana Ross
*Assistant Examiner* — Mohammad I Yusuf
(74) *Attorney, Agent, or Firm* — Williams Mullen

(57) ABSTRACT

Hollow decorative tubing fabricated from thin walled metallic stock material, the stock material preferably being stock tubing. Tubing is cold worked to impart any desired design such as simulated bamboo having realistic culm and node characteristics. The tubing is preferably formed into serial or repeating sections, each characterized by the desired design. For simulated bamboo, a realistic node is worked into the tubing between adjacent sections. The invention may be regarded as a method for manufacturing the resultant elongate hollow decorative tubing or, alternatively, an article of manufacture such as a chair incorporating the resultant elongate simulated bamboo article.

6 Claims, 5 Drawing Sheets

DECORATIVE HOLLOW TUBING FOR USE IN FURNITURE MANUFACTURE AND METHOD FOR MANUFACTURING

CROSS-REFERENCE TO RELATED APPLICATION

The present application is a continuation-in-part of U.S. application Ser. No. 11/728,765, filed on Mar. 27, 2007 now abandoned, which is a continuation-in-part of U.S. application Ser. No. 10/436,013, filed May 12, 2003, now abandoned, which claims the benefit of U.S. Provisional Application No. 60/379,103, filed May 10, 2002, the entire contents of all of which are incorporated herein by reference.

STATEMENT REGARDING GOVERNMENT SUPPORT

None

BACKGROUND OF THE INVENTION

1. Field of the Invention

The present invention relates to a method for manufacturing decorative hollow tubing and more particularly to decorative hollow tubing used for manufacturing furniture.

2. Description of the Related Art

Furniture is often constructed from decorative cylindrical structures. For example, bamboo and other grasses and woody plants have long been utilized to fabricate furniture and other articles. The appearance of such furniture and other articles is so pleasing as to have inspired many attempts to simulate bamboo and the like when rendered artificially from materials other than those of natural plants. Table legs are often formed in shapes which are cylindrical in nature and which may include shapes of various radii extending from the longitudinal axis of the table leg.

One of the unsolved needs of the furniture and other industries wherein it is desirable to provide decorative cylindrical tubing, such as simulated bamboo stalks in a realistic rendition of nodes and culms which characterize natural bamboo, while fabricating the decorative cylindrical tubing from inexpensive yet strong and durable tubular stock material. Many prior art attempts to manufacture such decorative tubing such as simulated bamboo depend upon inscribing nodes into tubing or, alternatively, deforming the stock material such that simulated nodes project outwardly from the tubing. Both approaches fail to achieve realistic effect.

Casting can realistically provide decorative cylindrical structures but cast construction, particularly from metals, has undesirable attributes. One is that resultant cylindrical structures are relatively heavy, being solid rather than hollow, compared to worked tubing. Although hollow castings can be produced, this greatly increases difficulty and expenses of manufacture. Another is that the cost of fabricating suitable dies providing the desired ornamentation is extremely expensive. A further problem is that cast metallic structures are usually brittle and unsuitable for fabricating furniture, which represents a broad use of such hollow decorative cylindrical structures. Brittleness leads to ready breakage and also prevents imparting mild curvature during fabrication to straight sections of decorative cylindrical structures. Although the product could be cast in the final desired configuration, this will likely increase the number of expensive dies required to fabricate a set of related articles of furniture. Still another problem with casting is that cast construction is difficult at best to weld, which may be required when fabricating assembled products such as furniture, in which sections of decorative cylindrical structures intersect.

SUMMARY OF THE INVENTION

The present invention describes a method for manufacturing decorative cylindrical tubing which exhibits a desired external ornamental configuration from thin walled metallic or plastic tubing. This construction provides a number of features. One feature of the invention is the ability to provide strength and durability of construction from metals or plastics. Another feature is the ability to utilize metallic material in stock form, such as extruded or rolled and welded stock.

An additional aspect is to avoid casting as a fabrication technique, thereby avoiding inherent disadvantages of casting such as expense and brittleness of the product. A further aspect of the present invention is that it achieves a realistic appearance of natural bamboo stalks or other desired ornamentation. Still another aspect is to provide a constituent material which simulates bamboo or other desired ornamentation while having the strength requisite for fabricating furniture while limiting the overall diameter of the decorative cylindrical tubing. A further aspect is that the decorative cylindrical tubing may be bent slightly to achieve desired contours without failing, displaying visible distortion such as wrinkling and cracking, or significantly weakening. A still further aspect is to be able to weld abutting sections of decorative cylindrical tubing.

The invention provides these qualities while realistically simulating bamboo or other desired ornamentation. To this end, the present invention contemplates fabricating decorative cylindrical tubing, utilizing thin walled tubing as a stock material and cold working the stock material to exhibit a desired ornamentation such as simulated nodes and simulated tapering of culms typical of natural bamboo. The invention may take the form of a stock material simulating bamboo or, alternatively, of any desired cylindrical shape and ornamentation.

Accordingly, the invention provides decorative cylindrical tubing in the form of thin walled metallic tube stock configured to simulate bamboo or other desired ornamentation. The invention also simulates characteristics of natural bamboo such as nodes and curvature of culms. Finally, the invention provides improved elements and arrangements thereof in an apparatus for the purposes described which is inexpensive, dependable and fully effective in accomplishing its intended purposes. These and other aspects of the present invention will become readily apparent upon further review of the following specification and drawings.

DESCRIPTION OF THE DRAWINGS

Various other aspects and features of the present invention will become more fully appreciated as the same become better understood when considered in conjunction with the accompanying drawings, in which like reference characters designate the same or similar parts throughout the several views and wherein.

DETAILED DESCRIPTION

Figure 1:
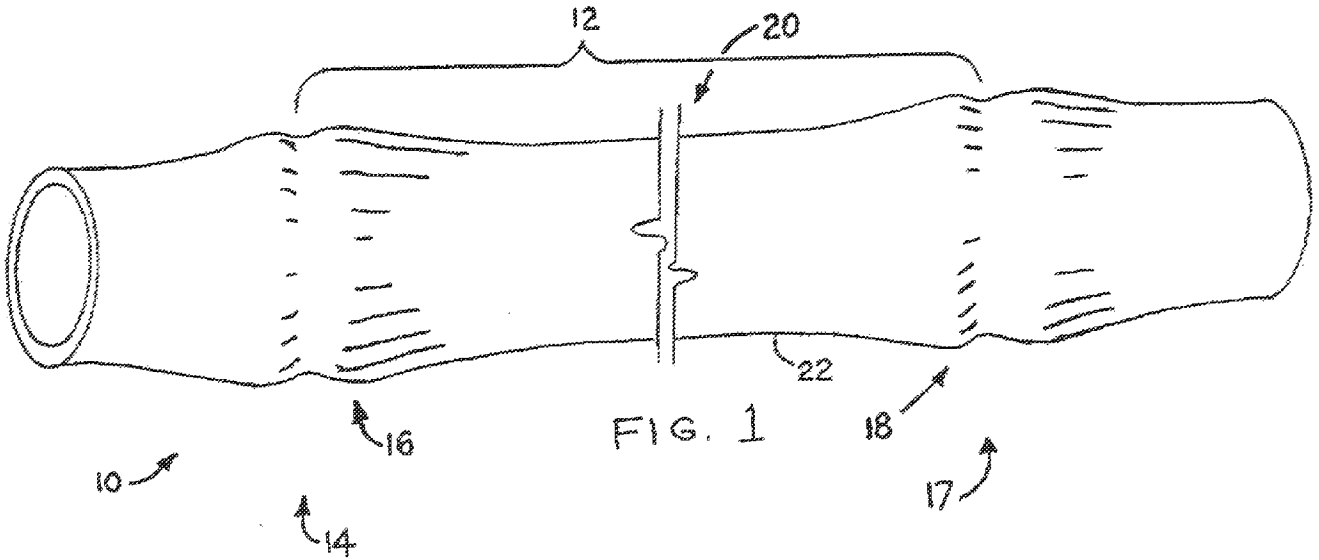
FIG. 1 is a perspective view of a length of a stock elongate structural material simulating bamboo formed according to the present invention.
Figure 2:
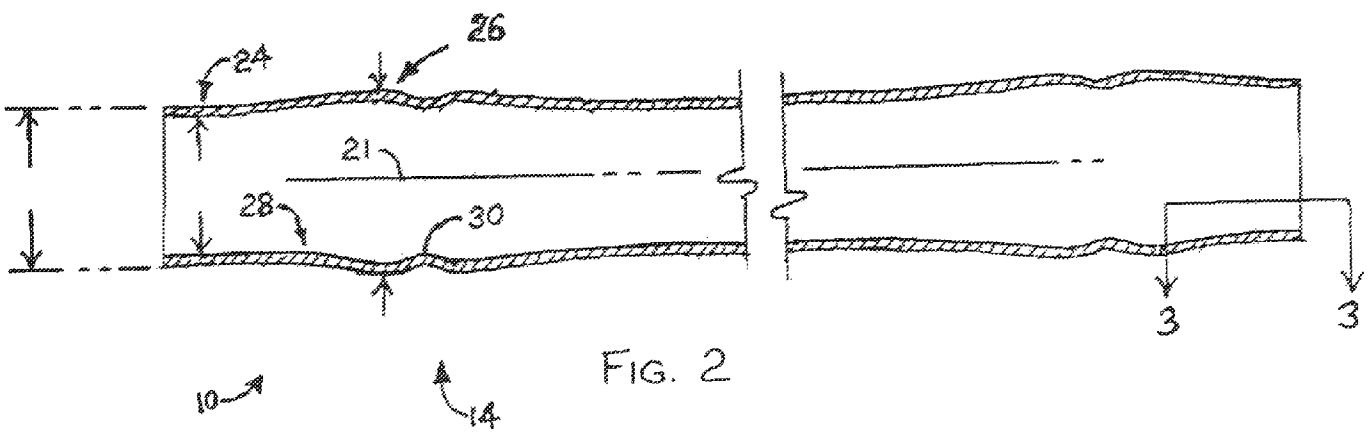
FIG. 2 is a side cross sectional view of the material of FIG. 1.

For illustrative purposes, FIGS. 1 and 2 of the drawings show a length of a stock elongate structural material 10 simulating bamboo. Designs, shapes and ornamentation other than bamboo can be created using the disclosed method, so long as the desired ornamentation is cylindrical in nature with varying radii extending from the longitudinal axis of the tubing. The stock material 10 is formed from stock tubing having cylindrical, annular configuration prior to being reformed to take on the nodes and taper of a culm of natural bamboo. The tubing is thin walled and malleable and has been cold worked to be configured to include at least one section, and preferably at least one additional abutting section, each corresponding to a section of a natural stalk of bamboo, where a section will be understood to extend between adjacent nodes. Thin walled signifies that combined thicknesses of the wall of the finished generally tubular or annular stock material simulating bamboo, taken at two diametrically opposing points along the circumference of the finished material, do not exceed one-half of the diameter of the open center of the tube taken along the same line as the two diametrically opposing points.

Where a series of abutting sections are provided, they may be fabricated from a single piece of tubing of desired length. Sections of culms of natural bamboo are characterized in that each has enlarged nodes separating adjacent sections, and in that each section is progressively, increasingly tapered from the minimum diameter of the section, usually at the middle, towards the maximum diameter located near each node. Both this characteristic taper and also joint structure of each node, which joint structure includes a defined crease where abutting sections meet, are reproduced in the present invention, using tubular stock material as a raw material. This was heretofore an unrealized goal in commercial production of simulated bamboo products.

The tubular stock material is both sufficiently malleable as to accept cold working to reproduce realistic node and culm characteristics, and also sufficiently rigid to provide structural members for furniture. Examples of preferred stock tubular material include rolled ferrous metallic stock, such as steel, and extruded aluminum material. Aluminum material will be understood to encompass aluminum and its alloys. However, other malleable, strong materials such as other metals and alloys, polyvinyl chloride, and other plastics could be utilized if desired.

The simulated section 12 is tapered to simulate the taper of a culm of natural bamboo. To this end, the simulated section 12 has a portion of a first node 14 at the proximal end 16 of the simulated section 12 and a portion of a second node 17 at the distal end 18 of the simulated section 12. As seen in FIGS. 1 and 2, the simulated section 12 is visibly tapered progressively along its length. The center 20 of the simulated section 12 has no taper, where taper is meant to signify curvature of the outer surface 22 of the simulated section 12 from a point 24 of minimum outer diameter towards the center 20 to a point 26 of maximum outer diameter taken at a node 14 or 17 of the simulated section 12. Of course, the simulated section 12 could be modified if desired so that there is always some taper therealong. The simulated section 12 will be understood to be typical of a repeating series of identical or similar sections. The stock material 10 may include any number of sections of the type typified by the simulated section 12, and is not necessarily limited to similar, repeating lengths.

Minimum and maximum outer diameters of other sections may be identical to those of the simulated section 12, although this represents a departure from natural bamboo. In natural bamboo, maximum and minimum outer diameters of each section generally become progressively smaller from the base of the stalk to the tip of the stalk. For purposes of fabricating articles from simulated bamboo, lengths of simulated bamboo are used wherein such decrease in dimensions is not discernible to casual observation. Similarly, the length of each one of a series of sections formed in a length of stock material according to the present invention may vary in a manner not found in nature.

Figure 3:
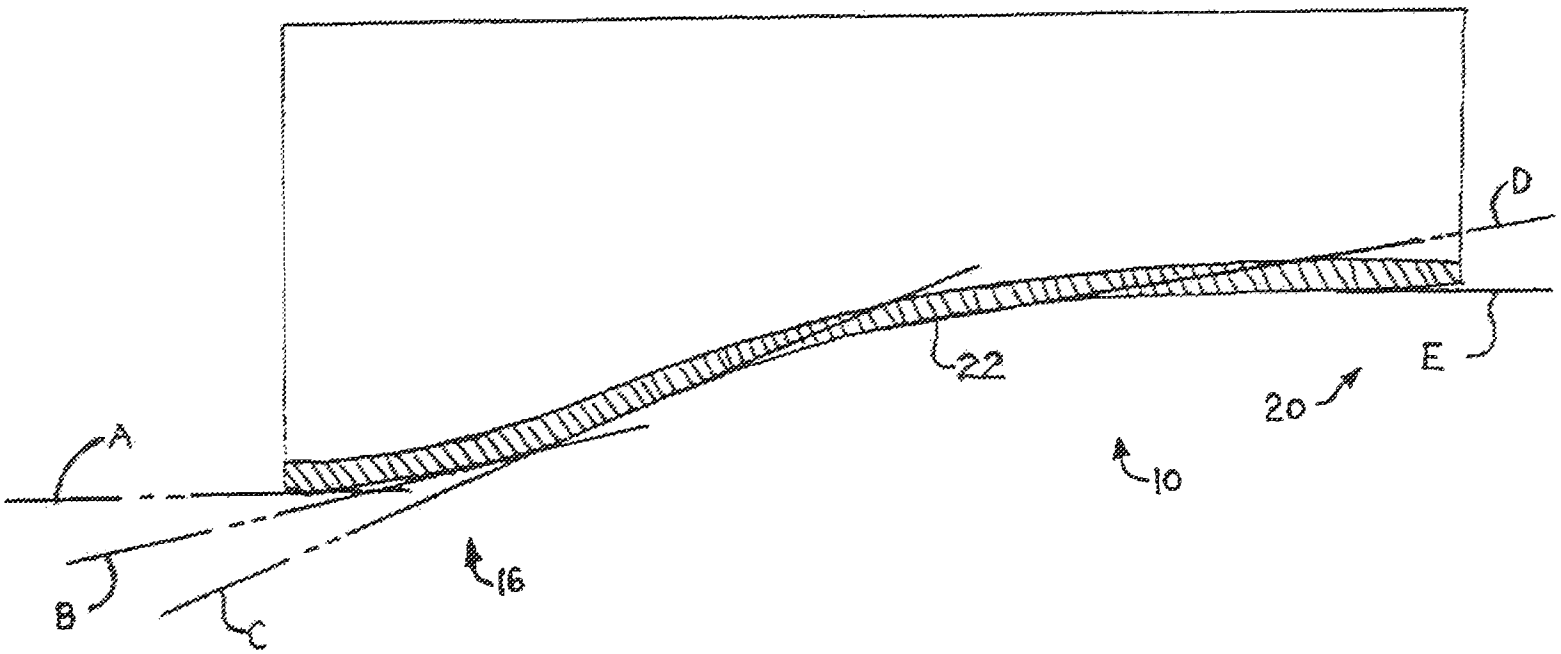
FIG. 3 is an enlarged detail view taken along line 3-3 of FIG. 2.

The nature of the tapering of section 12 will now be described, with reference to FIG. 3. The taper of the outer surface 22 of the simulated section 12 is curved and further is of variable radius. That is, the curve may be, for example, parabolic rather than being sinusoidal. The slope progressively increases when considered starting from the proximal end 16 and proceeding towards the center 20 when the simulated section 12 is horizontally oriented as depicted in FIGS. 1 and 2. Horizontal orientation signifies that the longitudinal axis 21, which is located along the hollow center of that section of structural material 10 including the simulated section 12. Slope characteristics are seen in FIG. 3 by comparing projection lines A, B, and C, which touch the surface 22 tangentially, slopes of lines A, B, and C deviating increasingly from the horizontal. Slope of lines C, D, and E then progressively decreases when considered starting from the proximal end 16 and proceeding towards the center 20.

The slope described above characterizes the proximal end 16. The distal end 18 is essentially a mirror image of the proximal end 16, and thus need not be shown to the scale and level of detail of FIG. 3. In summary, at the distal end 18, the slope progressively increases in magnitude, or deviation from the horizontal, then decreases when considered starting from a point located between the center 20 and the distal end 18, and proceeding to the distal end 18 (best seen in FIG. 2).

The simulated nodes 14 and 17 are disposed between and separate the simulated section 12 and additional sections essentially similar to the simulated section 12. The simulated nodes 14 and 17 are formed at abutting tapered portions of the simulated section 12 and any adjacent section where each section has the greatest diameter. The simulated nodes 14 and 17 are each cold work depressed into the stock material 10 such that the interior surface 28 is inwardly displaced, as indicated for the simulated node 14 by an inward bulge 30 in FIG. 2.

Figure 4:
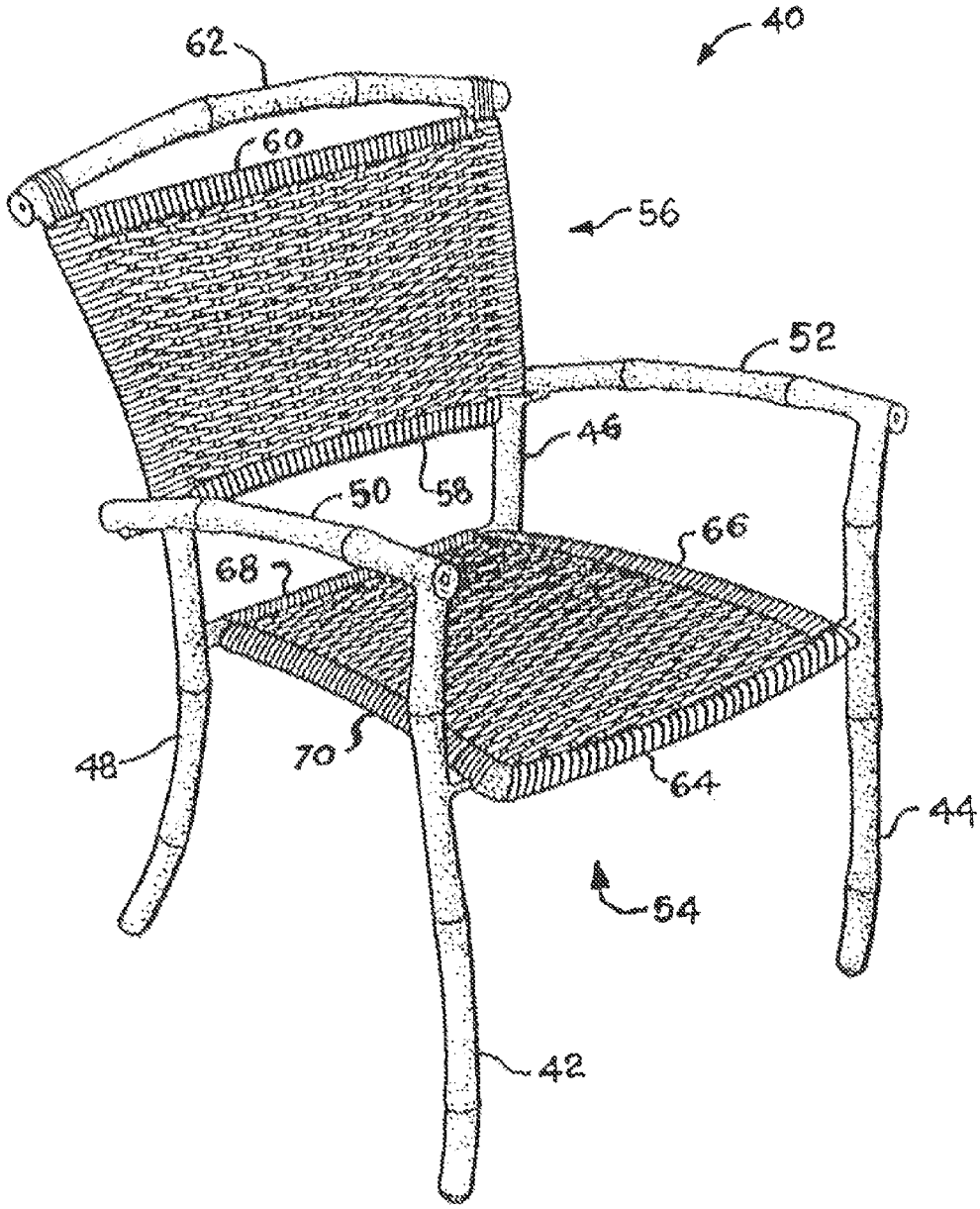
FIG. 4 is a perspective view of an article of furniture utilizing the stock material of FIG. 1.

Referring now to FIG. 4, an article of manufacture, including an article of furniture such as a chair 40, is fabricated using lengths of stock material 10 as elongate structural members, each of which is connected to at least one other elongate structural member formed from the stock material 10. The chair 40 is further shown in our co-pending Design Pat. No. D465,668, entitled Simulated Bamboo and Wicker Chair. The chair 40 has four vertical load bearing structural members 42, 44, 46, and 48. Two of the structural members 42 and 48 are connected by a generally horizontal armrest 50. Two of the structural members 44 and 46 are similarly connected by a generally horizontal armrest 52. A load bearing member such as a seat 54 is supported by the structural members 42, 44, 46, and 48. A seatback 56 has two horizontal members 58 and 60, each of which is fixed to two of the structural members 46 and 48. A horizontal cross brace 62 connects two of the structural members 46 and 48 at the top thereof. The seat 54 is supported by attachment of the peripheral frame members 64, 66, 68, and 70 to the vertical members 42, 44, 46, and 48.

To provide aesthetic benefits of simulation of bamboo, the members 42, 44, 46, 48, 50, 52, and 62 are made from the stock material 10. An advantage of the nature of the stock material 10 is that lengths of the stock material 10 can tolerate some bending, as seen by examining the structural members 42 and 48, among others, and still maintain the characteristic curvature of each section of simulated bamboo. The effect of simulated bamboo can be combined with other thematically related visual features. For example, the seat 54 and the seatback 56 are formed from real or simulated wicker construction. Real or simulated rattan is another example of thematically related material. Also, simulated bamboo members may be combined in the frame structure with members that do not simulate bamboo.

It should be noted that the entire length of every structural member of the chair 40 need not be worked to simulate bamboo. For example, concealed portions of the structural members 46 and 48 may retain their original stock configuration. Such construction saves cost of producing the chair 40 while still presenting a dominant impression of bamboo construction. The concealed structural members 58, 60, 64, 66, 68, and 70 also need not be worked to simulate bamboo.

Both lengths of stock material corresponding to the stock material 10 and also articles utilizing the stock material in fabrication may utilize alternative embodiments of the invention wherein a length of the stock material 10 may include the novel characteristics set forth above in combination with other configurations. For example, lengths of the stock material 10 may be configured according to the invention along only part of the entire length thereof. The remaining length may be of the original cross sectional configuration or, alternatively, may be formed to have another configuration. The remaining length may be ornamented utilizing a different decorative scheme, or may be unornamented. In the example of the embodiment of FIG. 4, only visible portions of the members 42, 44, 46, 48, 50, 52, and 62 need include a series of abutting sections, each of which is tapered to simulate taper of a culm of natural bamboo in order to present the visual effect of bamboo framed furniture.

The simulated stock material 10 thus described is formed from cylindrical, annular tubing by cold working. It is thought that the best way of imparting the described characteristics to tubing is accomplished by using dies. The preferred method is to place a plurality of complementing dies around a tube 88, urge the dies inwardly such that they converge in complementing contact with the tube 88. This arrangement is shown diagrammatically in FIG. 5, with the dies 80, 82, 84, and 86 shown in a position drawn away from the tube 88. The dies 80, 82, 84, and 86 are held in a rotatable spindle (not shown) such that they rotate around the tube 88. The tube 88 is held stationary in a fixed position (i.e., holding it stationary with respect to both axial and rotational directions) by an external tube clamp, while the dies 80, 82, 84, and 86 rotate about the tube 88.

Figure 6:
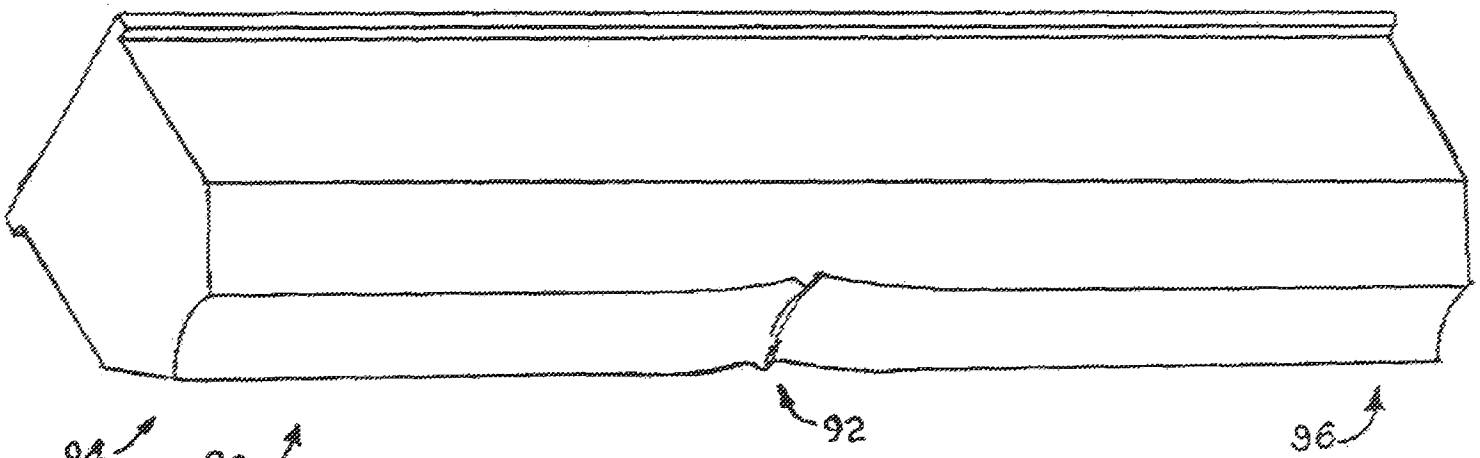
FIG. 6 is an enlarged, perspective detail view of a die seen at the left of FIG. 5.
Figure 5:
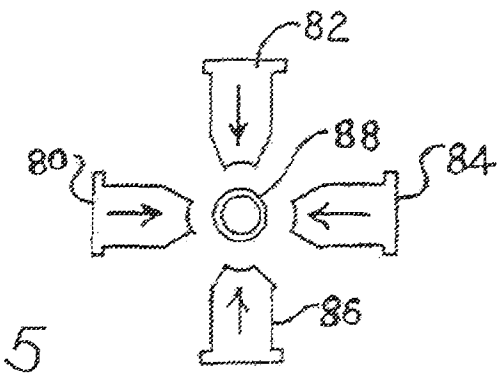
FIG. 5 is a diagrammatic and elevational view of apparatus employing dies to form the stock material of FIG. 1.

The dies 80, 82, 84, and 86 are urged or forced inwardly towards the tube 88, as indicated by arrow in FIG. 5, as they rotate about tube 88. The centripetal force of rotation acts on dies 80, 82, 84, and 86 in a balanced fashion. This method enables the dies such as die 80 (see FIG. 6) to bear a female die face 90, which includes features 92 rendered as a negative of a simulated node, to contact the outer surface of tube 88. Because the tube 88 is under compressive forces, the tube 88 will deform ("buckle") inwardly to conform to the void between the dies 80, 82, 84, and 86, causing the tube 88 to take the inverse shape of the die(s) 80, 82, 84, and 86. The surfaces of die face 90 towards the ends 94 and 96 are cylindrical and conform to the outer surface of the tube 88. This enables nodes to be formed in the tube 88 at periodic, selectable intervals while the tube 88 is being held immobile, with no axial and rotational movement. The tube 88 remains motionless while the dies are in contact with the tube 88 surface and throughout the forming operation. Minor variations in distances between adjacent nodes will not be discernible.

A length of stock material 10 is formed by repeating the operation for forming nodes, with relative positions of the dies 80, 82, 84, and 86 and the tube 88 being adjusted to suit. The end clamps are then applied to the tube 88 to keep it stationary in a fixed position, restricted without any axial or rotational motion. It would be possible to fabricate dies (not shown), including more than one node, so that more than one section of simulated bamboo is formed in every forming operation. However, the apparatus and method described above will result in minimal capital outlay for dies, and also confer ability to form only one section on the tube 88. Also, this may be desirable in articles wherein only a short section of a structural member simulating bamboo is revealed.

Figure 7A:
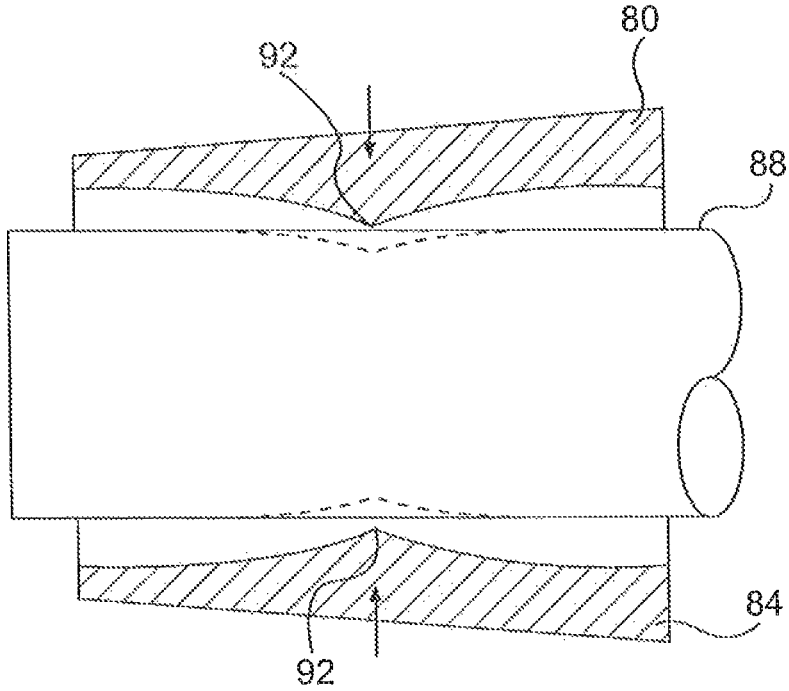
FIG. 7 is a cross-sectional view of the method of the invention for forming the tubes.
Figure 7B:
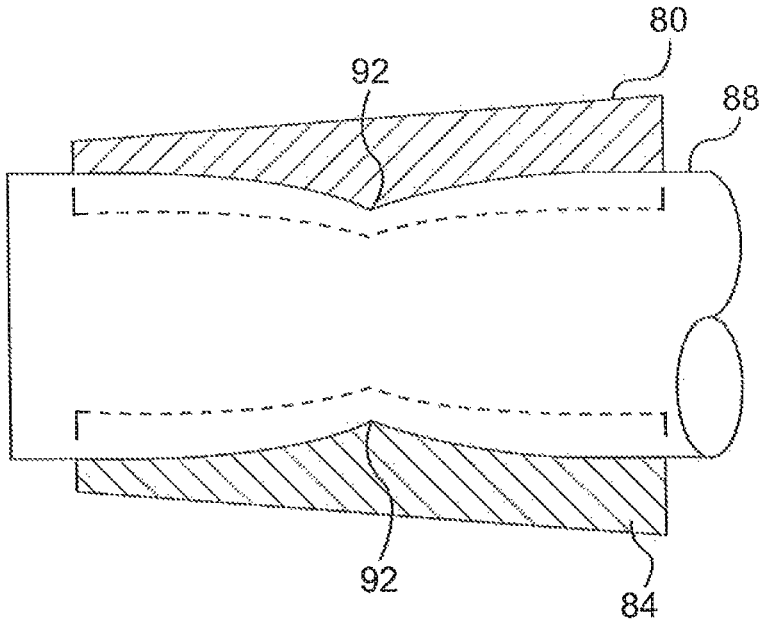

FIG. 7 shows a cross-sectional view of the method of the invention. FIG. 7A shows the dies prior to being pressed into the tube and FIG. 7B shows the dies actually pressed into the surface of the tube. A length of the tube 88 is held stationary in place allowing no rotational or axial movement. The dies (only two are shown for simplicity) 80, 84 are spun around the tube 88 and are pressed into the surface of the tube 88 using cold work. Features 92 on the surfaces of the dies are imparted to the surface of the tube 88 to create nodes and other surface features to simulate bamboo.

Other methods may be employed to form the stock material 10. For example, dies (not shown) extending the full length of a tube which is to be reconfigured to simulate bamboo may be utilized. Where full length dies are utilized, tubing may be urged outwardly, such as by applying internal fluid pressure, an example being hydroforming. Alternatively, specially formed rollers may be employed in a die rolling method. Die forming, rolling, and other techniques may be combined if desired.

To achieve external surface designs other than bamboo, different dies would be employed. The dies are rendered as a negative of the ornamentation desired on the external surface of the decorative hollow tubing.

It is to be understood that the present invention is not limited to the embodiments described above, but encompasses any and all embodiments within the scope of the following claims.

What is claimed is:

1. A method for manufacturing hollow decorative tubing used in furniture manufacture, comprising:

providing hollow, cylindrical tubing having an outer surface defining a perimeter of the tubing;

providing a plurality of complementing dies which include a negative of a desired external design for the tubing;

positioning the dies about the perimeter of the tubing;

rotating the dies while holding the tubing stationary in a fixed position, without axial or rotational movement; and contacting the dies on the outer surface of the tubing while the dies are in rotation and forcing the dies against the outer surface of the tubing to deform the tubing to the desired external design of the dies;

wherein said contacting step is performed without allowing relative axial movement between said dies and said tubing, and wherein said external design provides the tubing with the appearance of a culm of natural bamboo, said external design including enlarged nodes separating adjacent sections.

2. The method of claim 1, wherein four dies are provided.

3. The method of claim 1, wherein the hollow tubing is formed from one or more of rolled ferrous metal, extruded aluminum, extruded aluminum alloys, metals, metal alloy, polyvinyl chloride, plastics, or combinations thereof.

4. The method of claim 1, wherein the dies impart nodes along the length of the tubing at periodic, selectable intervals.

5. The method of claim 1, wherein forcing the dies against the outer surface of the tubing is performed using cold work.

6. A method for manufacturing hollow decorative tubing used in furniture manufacture, comprising:

providing hollow, cylindrical tubing having an outer surface, the outer surface defining a perimeter of the tubing, the tubing being formed from one or more of rolled ferrous metal, extruded aluminum, extruded aluminum alloys, metals, metal alloy, polyvinyl chloride, plastics, or combinations thereof;

providing four complementing dies which include a negative of a desired external design for the tubing; positioning the dies about the perimeter of the tubing;

rotating the dies while holding the tubing stationary in a fixed position, without axial or rotational movement; and contacting the dies on the outer surface of the tubing by cold work while the dies are in rotation and forcing the dies against the outer surface of the tubing to deform the tubing to the desired external design of the dies, the external design simulating a culm of natural bamboo, said external design including enlarged nodes separating adjacent sections;

wherein said contacting step is performed without allowing relative axial movement between said dies and said tubing.

* * * * *